US007487857B2

(12) United States Patent
Wolf

(10) Patent No.: US 7,487,857 B2
(45) Date of Patent: Feb. 10, 2009

(54) SONIC COUPLING BETWEEN AN INTAKE TRACT OR ENGINE COMPARTMENT AND THE INTERIOR OF A MOTOR VEHICLE

(75) Inventor: Anton Wolf, Gelnhausen Haitz (DE)

(73) Assignee: WOCO Industrietechnik GmbH, Bad Soden-Salmuenster (DE)

( * ) Notice: Subject to any disclaimer, the term of this patent is extended or adjusted under 35 U.S.C. 154(b) by 12 days.

(21) Appl. No.: 11/816,408

(22) PCT Filed: Feb. 13, 2006

(86) PCT No.: PCT/DE2006/000242

§ 371 (c)(1),
(2), (4) Date: Aug. 15, 2007

(87) PCT Pub. No.: WO2006/086950

PCT Pub. Date: Aug. 24, 2006

(65) Prior Publication Data

US 2008/0135330 A1 Jun. 12, 2008

(30) Foreign Application Priority Data

Feb. 16, 2005 (DE) ..... 10 2005 006 914

(51) Int. Cl.
*F01N 1/16* (2006.01)

(52) U.S. Cl. ..... 181/247; 181/229; 181/241; 181/248; 181/264; 181/271

(58) Field of Classification Search ..... 181/229, 181/241, 247, 248, 264, 271
See application file for complete search history.

(56) References Cited

U.S. PATENT DOCUMENTS 3,194,589 A * 7/1965 Bohls et al. ..... 285/49
3,574,358 A * 4/1971 Cassel ..... 285/53

(Continued)

FOREIGN PATENT DOCUMENTS

DE 199 22 216 A1 11/2000

(Continued)

OTHER PUBLICATIONS

International Search Report dated Jun. 13, 2006, issued in corresponding PCT/DE2006/000242, filed Feb. 13, 2006.

*Primary Examiner*—Walter Benson
*Assistant Examiner*—Jeremy Luks
(74) *Attorney, Agent, or Firm*—Christensen O'Connor Johnson Kindness PLLC

(57) ABSTRACT

An apparatus for sonic coupling between an intake tract or engine compartment and a vehicle interior of a motor vehicle has a housing into which sound enters from the intake tract via a first line, and out of which sound exits into the vehicle interior via a second line. A transmission body is arranged in the housing, the transmission body having a gas-tight separating wall between a sound inlet into the housing and a sound outlet out of the housing. The position of the separating wall is held essentially constant by a positioning device. A transmission wall between the separating wall and the housing provides an acoutis transfer function that is adjustable. The separating wall runs generally perpendicular to the longitudinal axis of sound propagation and the transmission wall runs at an angle α to the longitudinal axis of sound propagation.

35 Claims, 2 Drawing Sheets

U.S. PATENT DOCUMENTS

| | | | | |
|---|---|---|---|---|
| 3,687,224 | A * | 8/1972 | Lundin | 181/207 |
| 4,993,513 | A * | 2/1991 | Inoue et al. | 181/282 |
| 6,600,408 | B1 | 7/2003 | Walter | |
| 6,644,436 | B2 * | 11/2003 | Hofmann et al. | 181/214 |
| 6,905,144 | B2 * | 6/2005 | Vila | 285/223 |
| 2003/0057015 | A1 * | 3/2003 | Helber et al. | 181/240 |
| 2004/0026166 | A1 * | 2/2004 | Woods | 181/264 |
| 2004/0104071 | A1 * | 6/2004 | Wahlstrom et al. | 181/248 |
| 2005/0029868 | A1 | 2/2005 | Monig | |
| 2005/0121255 | A1 * | 6/2005 | Hofmann et al. | 181/250 |
| 2005/0121256 | A1 | 6/2005 | Hofmann | |

FOREIGN PATENT DOCUMENTS

| | | | |
|---|---|---|---|
| DE | 100 42 012 | B4 | 5/2001 |
| DE | 101 49 169 | C1 | 12/2002 |
| DE | 102 23 873 | A1 | 12/2003 |
| EP | 1 138 887 | A2 | 10/2001 |
| EP | 1 306 829 | A2 | 5/2003 |
| EP | 1 365 120 | B1 | 6/2004 |

* cited by examiner

SONIC COUPLING BETWEEN AN INTAKE TRACT OR ENGINE COMPARTMENT AND THE INTERIOR OF A MOTOR VEHICLE

BACKGROUND

The present application relates to an apparatus for sonic coupling between an intake tract or engine compartment and a vehicle interior of a motor vehicle. The apparatus may be positioned within the flow path of uncompressed or compressed intake air. Such apparatus are already known for sound modulation.

For example, DE 199 22 216 describes sound modulation using resonance effects, wherein a cross-section expansion is present within a sound wave path length between the intake tract of an internal combustion engine of a motor vehicle and an interior of the motor vehicle. The expansion leads to the formation of a resonator, so that sound energy from the intake tract is absorbed by resonance within a desired frequency band and can be conducted by the resonator to the vehicle interior, via a membrane functioning as a vibrator.

DE 100 42 012 B4 describes a similar apparatus for creating noise in a motor vehicle. In this known apparatus, there is a hollow body that is divided into at least two spaces by at least one vibratable membrane. The membrane fulfills specific functions, namely preventing a flow in the hollow body, controlling a frequency range, and amplifying noises to be transmitted.

EP 1 138 887 A2 describes an acoustic transducer for exhaust pulsation. The transducer is designed in the form of an impedance transducer that radiates engine-related sound by coupling to the pulsations of an exhaust flow using a membrane in the interior of a motor vehicle. In this case, as well, resonance characteristics are used for adjusting the radiated airborne sound.

EP 1 365 120 B1 discloses an acoustic transducer in which the radiated sound is adjustable, largely independent of changes in pressure at the input of a transmission body. A rigid or stiff vibration body is used that is vibratably held using a mount. The mount can be displaced against elastic force in the vibration direction of the vibration body. Low-frequency fluctuations in pressure can thus be compensated in the input area of the transmission body using corresponding relative displacements of the mount, together with the vibration body held thereon, in that the mount displaces until the elastic force creates an equilibrium. In contrast to this, high frequency airborne sound that is to be coupled out can excite the vibration body to vibrate in order to cause radiation of audible modulated airborne sound.

EP 1 306 829 A2 discloses an apparatus for transmitting internal combustion engine sounds that comprises a housing in which a separating wall is located. A flap element passes through the separating wall.

DE 101 49 169 C1 relates to an acoustic transducer head. The transducer is designed so that exhaust pulsations of an internal combustion engine of a motor vehicle are converted to vibrations in a largely closed space. In addition, there is functionality even at static pressures of 0.5 to 1 bar, because an excitation membrane is coupled either to a sound radiation membrane or to a body sound exciter with pressure compensation. The necessity for either two membranes, or for one membrane and a body sound exciter, demonstrates the complexity of this structure.

Another apparatus for creating noise in a motor vehicle is disclosed in DE 102 23 873 A1, which describes a sound transmission device that has at least two vibratable elements. An acoustically inactive wall is arranged between the elements, which are coupled via a connector that passes through the wall. This structure is very complicated due to the number of parts.

Although the above acoustic transducers are known in the art, there is still a need for a cost-effective device with a long service life, which can be used for the intentional radiation of sound into the interior of a motor vehicle.

SUMMARY

An apparatus for sonic coupling between an intake tract or engine compartment and a vehicle interior of a motor vehicle is described herein, the apparatus having a housing into which sound enters from the intake tract or engine compartment via a first line, and out of which the sound exits into the vehicle interior via a second line. The apparatus has a transmission body for sound that is arranged in the housing such that the sound enters or impinges on said transmission body via the first line. A gas-tight separating wall is located between a first sound inlet into said housing and a second sound outlet out of said housing. The position of the gas-tight separating wall in said housing is generally held constant by a positioning apparatus. A transmission wall is positioned between said separating wall and said housing via which the acoustic transfer function of the transmission body for sonic coupling can be adjusted. Said transmission wall is either joined to the separating wall or is integral with said separating wall. The separating wall, at least in one area, runs mainly perpendicular to the longitudinal axis of the sound propagation at the inlet and/or outlet of the housing, and said transmission wall, at least in one area, runs at an angle $\alpha$ to the longitudinal axis of the sound propagation at said inlet and/or outlet of said housing. In an embodiment, the angle $\alpha$ may be defined such that $\alpha<\pm 30°$.

In an embodiment, the positioning apparatus is functionally related on the one hand to said separating wall and on the other hand to said housing. The area of the separating wall affected by the positioning apparatus may be reinforced or thicker. In an embodiment, the positioning apparatus may be mounted between said separating wall and said housing, between said separating wall and said first line, or between said separating wall and said second line. The positioning apparatus may include a tension spring, such as a helical spring or the like; a foamed part, such as a foam wedge; and/or a suspension.

In an embodiment, an external tube may be provided that comprises said housing and said second line. An internal tube may comprise said first line and said positioning apparatus, said internal tube preferably being stiff or rigid. It may further be provided that said internal tube is inserted at least partially into said external tube, such that the positioning apparatus is arranged mainly within said housing. The internal tube may have at least one aperture, preferably a plurality of apertures, in the area of said positioning apparatus and in the area of said transmission wall.

The first line, the housing, the second line and/or the external tube may include material comprising aluminum or plastic, and/or said internal tube may include material comprising aluminum, plastic, or foamed material. If the latter, said internal tube preferably includes foamed material in the area of the positioning apparatus.

It may also be provided that said separating wall and/or said transmission wall include(s) an elastomer film, a plastic film, or a textile membrane. It is furthermore suggested that said transmission wall is gas-tight.

In yet another embodiment, said transmission wall, at least in one area, runs at an angle $\alpha$ to the longitudinal axis of the sound propagation at said inlet and/or outlet of said housing, wherein the angle $\alpha<\pm 10°$.

The transmission body may be pot-shaped, such as in the shape of a flower pot. Moreover it may be provided that said transmission body has an edge that is either joined to said transmission wall or is integral with said transmission wall, and acts on said housing. The transmission body is preferably mounted between said housing and said first line.

The edge of said transmission body may be mounted between said tube edge of said internal tube and an expansion of said external tube. Alternatively, said edge of the transmission body may be mounted between a flange molded on said internal tube and a flange of said external tube that is joined thereto. If desired, the flanges may be detachably joined.

In an embodiment, the acoustic transfer function may be adjustable by adjusting the effective surface area and/or at least one material property of said transmission wall and/or said aperture(s) in said internal tube. It can furthermore be provided that the stiffness, the modulus of elasticity, at least one damping characteristic, and/or the mass of said transmission wall is/are variable with an adjustable material property. It may also be provided that the dimensioning of each aperture, the number of apertures, and/or the placement of said aperture(s) is/are variable for adjusting the acoustic transfer function.

In an embodiment, the housing may comprise a tube, line, or hose. Alternatively, the housing may be comprised by a tube, line, or hose. It can also be provided that said housing is arranged in the flow path of uncompressed or compressed intake air of the motor vehicle.

The present application is thus based on the unique perception that in a motor vehicle, either between an engine compartment and a vehicle interior, or between an intake tract of an internal combustion engine and the vehicle interior, using compressed or uncompressed intake air for transmitting sound, a change in cross-section and a membrane arranged mainly perpendicular to the direction of flow are not necessarily required. Rather, a transmission wall can be used that is not mainly perpendicular to the direction of flow or to the longitudinal axis of the sound propagation from the intake tract or engine compartment to the vehicle interior. A transmission wall can also be used that does not fulfill the function of compensating pressure so it can be as thin as desired in order to transmit sound, optimally 1:1. Accordingly, in an embodiment, a transmission body generally in the shape of a flower pot is used, the side wall of which represents the aforesaid transmission wall, while its bottom represents a gas-tight wall and fulfills the pressure compensation function. The transmission body can be mounted with its separating wall facing the vehicle interior and with the latter facing away. The transfer function of the transmission body is primarily adjustable via the effective surface area of the transmission wall and/or the material properties thereof. The effective surface is the vibratable surface of the transmission wall, which is adjustable using intentional fixation of certain surface areas. Not only is the mass of the transmission wall considered to be a material property, but also its stiffness, modulus of elasticity, and/or damping characteristics.

Furthermore, the transmission wall may be seated in a housing with a separating wall, which for instance may be arranged mainly perpendicular to the longitudinal axis of the sound propagation from the intake tract or engine compartment to the vehicle interior, such that the separating wall essentially does not contribute to the acoustic coupling. For this purpose, the separating wall is held by means of a positioning apparatus so that during operation, the separating wall remains in a particular position, not only regardless of the gas pressure acting on it, but also for the entire service life of the apparatus. Potential setting behavior of the material of the transmission body is largely compensated. The positioning apparatus may be realized in the form of a helical spring that holds the transmission body under tension in the housing, or as a support body that in the area of the transmission wall is perforated, stiff, or rigid (i.e., not vibratable). The effective surface area of the transmission wall can be adjusted using the apertures or holes in the support body.

In an embodiment, the transmission body and the positioning apparatus are arranged in a housing that itself can be comprised by a tube, line, or hose. The housing can be provided by an external tube, while the positioning apparatus, in the case of the embodiment as a support body, can be part of an internal tube at least partially inserted therein.

In preferred embodiments, the separating wall is embodied with the transmission wall in a membrane that is made from a material such as an elastomer, a plastic film, or made of a textile, whereby the separating wall can also have a material strength that is higher than that of the transmission wall.

Thus for the first time it is possible to provide an apparatus for acoustic coupling between an intake tract or engine compartment and a vehicle interior of a motor vehicle that can be produced in a cost-effective and simple manner, and that acts consistently over its entire service life.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
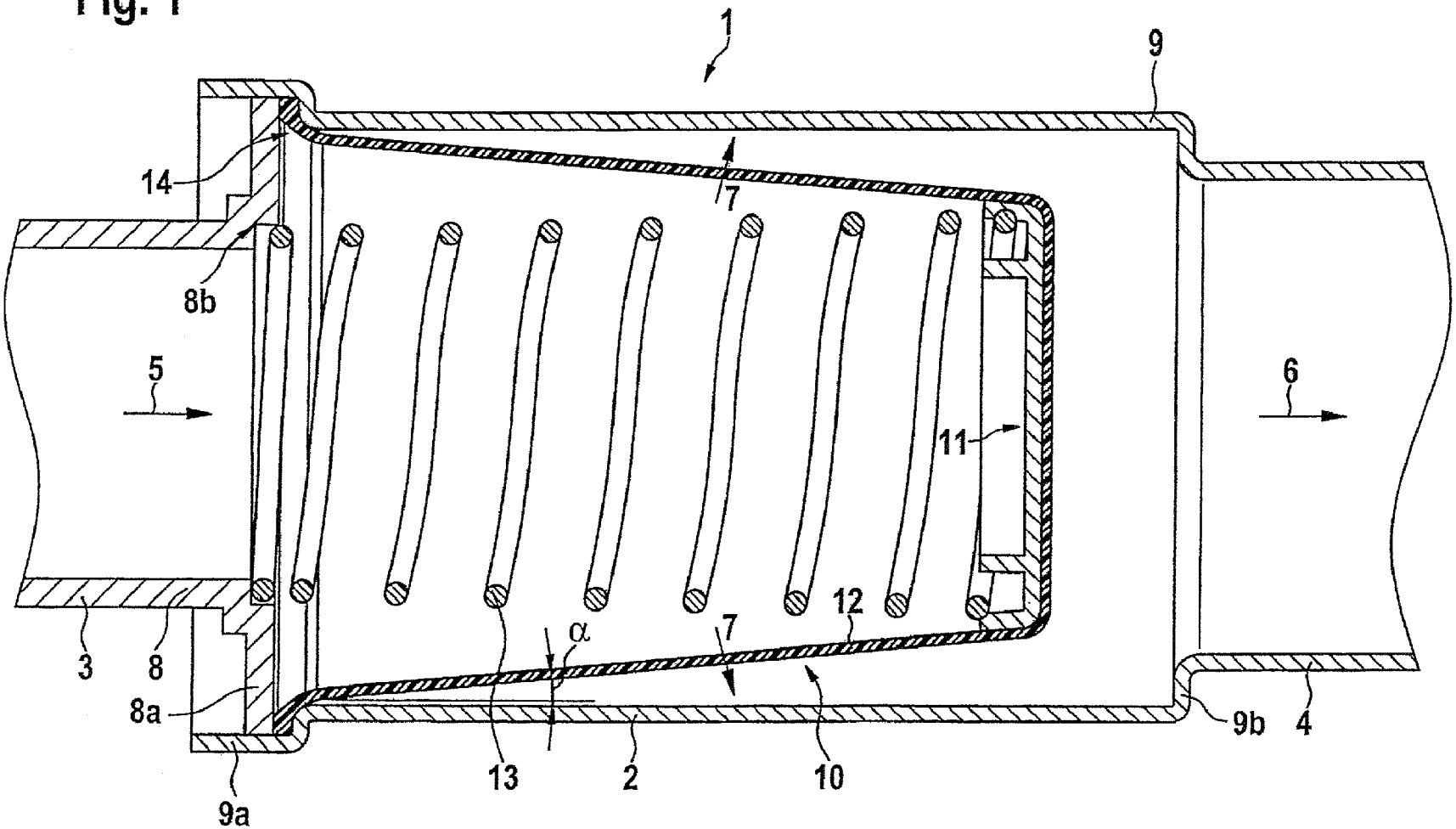
FIG. 1 is a section view of an apparatus arranged between an engine compartment and a motor vehicle interior.

In the following description, two exemplary embodiments are explained in detail using schematic drawings as examples. As can be seen in FIG. 1, an acoustic coupling apparatus 1 is arranged with its housing 2 between a line 3 from an engine compartment (not shown) and a line 4 to a vehicle interior (not shown) of a motor vehicle (not shown). The housing 2 is generally tubular, with a longitudinal axis that generally coincides with the longitudinal axis 5 of an acoustic inlet into the housing 2, and with a longitudinal axis 6 of a sound outlet out of the housing 2. The line 3 is part of an internal tube 8, while the housing 2 and also the other line 4 are part of an external tube 9, whereby the internal tube 8 is partially inserted into the external tube 9, concentric therewith, such that a tube edge 8*a* of the internal tube 8 is positioned against an expansion 9*a* of the external tube 9. In the area of the housing 2, the external tube 9 is wider than in the area of the line 4 so that a setp 9*b* is provided between the housing 2 and the line 4.

A transmission body 10 is provided within the housing 2. The transmission body 10 is generally shaped like a flower pot and, in one embodiment, may be made of an elastomer film. The transmission body 10 comprises a gas-tight separating wall 11 that is mainly perpendicular to said longitudinal axes 5,6 and a transmission wall 12 that extends from the separating wall 11 to the area of the sound inlet into the housing 2. The transmission wall 12 is thinner than the separating wall 11. In addition, the transmission wall 12 is arranged at an acute angle α of approximately 5° to said longitudinal axes 5, 6.

In order to prevent the position of the separating wall 11 from changing while the acoustic coupling apparatus 1 is operating, for instance because of pressure fluctuations or a material setting behavior, the separating wall 11 is held in position with a tension spring 13. The tension spring 13, which represents a positioning apparatus, is mounted between the line 3 or the internal tube 8 and the separating wall 11. In one embodiment, the tension spring 13 is mounted in the area of a step 8*b* of the internal tube 8. The separating wall 11 is materially reinforced in the area in which the tension spring 13 acts on the separating wall 11.

The transmission body 10 also comprises an edge 14 on the open end of the transmission wall 12, with which the transmission body 10 is mounted between the line 3 from the engine compartment or tube edge 8*a* of the internal tube 8 and the housing 2 or the expansion 9*a* of the external tube 9.

When sound is applied to the acoustic coupling apparatus 1, it exits from the line 3 from the engine compartment along the arrow 5 in FIG. 1 and enters into the transmission body 10. A functional division occurs in the transmission body 10 such that the separating wall 11 compensates pressure while the sound is transmitted via the transmission wall 12, as depicted by the arrows 7 in FIG. 1. The transmission wall 12 thus exclusively provides the function of sound transmission and for this purpose can be as thin as is desired in order to transmit sound, which optimally is 1:1. It is possible to modulate the sound in a simple manner in that the effective surface area of the transmission wall 12 and/or the material properties thereof are varied. The material properties of the transmission wall 12 are particularly easy to adjust via the mass of the material forming the transmission wall 12. Likewise, stiffness, modulus of elasticity, or damping characteristics can be adjusted, it naturally being possible to adjust all of these parameters anisotropically. The transmitted and/or modulated sound then leaves the acoustic coupling apparatus 1 along the arrow 6 in FIG. 1.

The sonic coupling apparatus 1 is thus functional without a cross-sectional enlargement in a line system from an engine compartment to a vehicle interior and without the use of a membrane that is simultaneously a vibrating body and a pressure compensating element. The separation of functions for pressure compensation and sound transmission also makes it possible to precisely adjust the sound to be radiated into the vehicle interior in a simple manner over the entire service life of the acoustic coupling apparatus 1.

Figure 2:
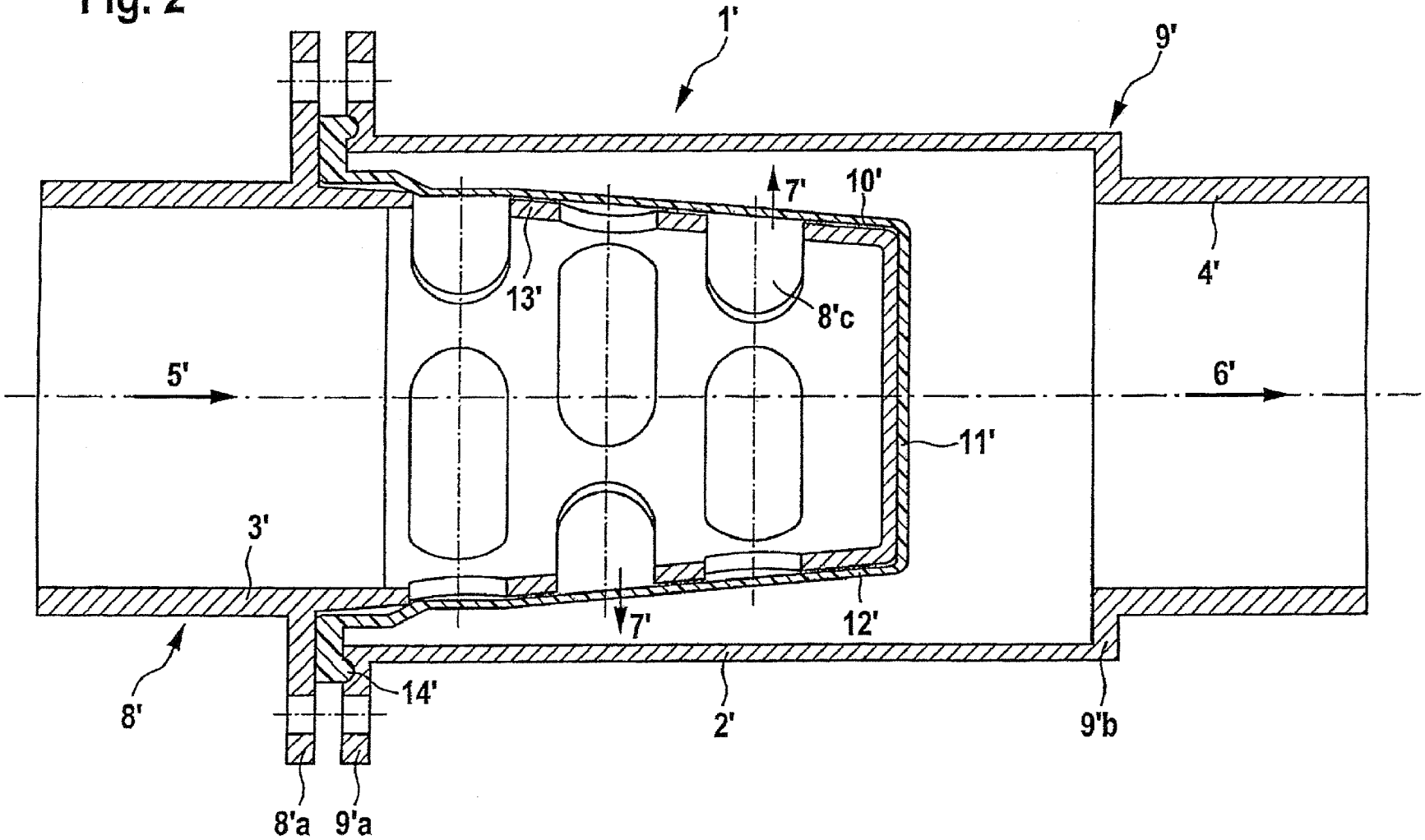
FIG. 2 is a section view of an alternate embodiment depicted in the same manner as FIG. 1.

An alternative embodiment of an acoustic coupling apparatus 1' is depicted in FIG. 2 and, like the acoustic coupling apparatus 1, includes a housing 2' between a first line 3' from an engine compartment and a second line 4' to a vehicle interior. The first line 3' extends into the housing 2' in the form of an internal tube 8' in order to position a transmission body 10' within the housing 2', that is, in order to provide a positioning apparatus 13' in the form of a stiff or rigid support body. The internal tube 8' can be made of a plastic that has, in the area of the transmission body 10', a plurality of apertures 8'*c* radial to the longitudinal axis 5' of the sound inlet into the housing 2' as well as to the longitudinal axis 6' of the sound outlet out of the housing 2'. The transmission body 10' is positioned against the internal tube 8', whereby no aperture is provided in the internal tube 8' in the area of a separating wall 11' of the transmission body 10', in contrast to the area of the internal tube 8' against which the transmission wall 12' is positioned, so that the effective surface area of the transmission wall 12' is adjustable via the apertures 8'*c*, and thus the acoustic coupling is adjustable with its longitudinal axis 7' in the area of each aperture 8'*c*. The transmission body 10' can comprise overall a textile membrane that it is mounted between a first flange 8'*a* on the internal tube 8' and a second flange 9'*a* of an external tube 9, whereby the external tube 9' encircles the housing 2' as well as the second line 4', and whereby a step 9'*b* is arranged between the housing 2' and the second line 4'. A fastening member such as a screw (not shown) is provided through the flanges 8'*a* and 9'*a* for detachable fixing of the flanges.

When sound enters the transmission body 10' along the arrow 5', it exits therefrom along the arrows 7' in the area of the apertures 8'*c* in order to leave the acoustic coupling apparatus 1' along the arrow 6', as depicted in FIG. 2. The sound can be modulated using the dimensions and geometry of the apertures 8'*c* in the internal tube 8', which is why the apertures 8'*c* can also be called "sound apertures."

The acoustic coupling apparatus 1' generally has the same functions as the acoustic coupling apparatus 1, however with a simpler and more cost effective structure.

While various embodiments have been illustrated and described, it will be appreciated that changes therein can be made without departing from the spirit and scope of the invention. The features disclosed in the foregoing specification, in the drawings, and in the claims may be implemented, both individually and in any desired combination, to achieve the advantages of the invention in its various embodiments.

LIST OF REFERENCE NUMERALS

1, 1' Sonic coupling apparatus
2, 2' Housing
3, 3' Line from engine compartment
4, 4' Line to vehicle interior
5, 5' Longitudinal axis of sound inlet into housing
6, 6' Longitudinal axis of sound outlet out of housing
7, 7' Longitudinal axis of sonic coupling
8, 8' Internal tube
8*a* Tube edge
8'*a* Flange
8*b* Step
8'*c* Aperture
9, 9' External tube
9*a* Expansion
9'*a* Flange
9*b*, 9'*b* Step
10, 10' Transmission body
11, 11' Separating wall
12, 12' Transmission wall
13, 13' Tension spring
14, 14' Edge

The invention claimed is:

1. Apparatus for sonic coupling between an intake tract or engine compartment and a vehicle interior of a motor vehicle, having a housing into which sound enters from said intake tract or engine compartment via a first line and out of which sound exits into said vehicle interior via a second line, said apparatus further having a transmission body for sound that is arranged in said housing such that the sound enters or impinges said transmission body via said first line, a gas-tight separating wall between a sound inlet into said housing and a sound outlet out of said housing, the position of said separating wall being held constant by a positioning apparatus, and a transmission wall between said separating wall and said housing, via which an acoustic transfer function of said transmission body for sonic coupling is adjustable, wherein said transmission wall is joined to or is integral with said separating wall, and wherein said separating wall, at least in one area, runs generally perpendicular to the longitudinal axis of sound propagation at at least one of said inlet or outlet of said housing, and said transmission wall, at least in one area, runs at an angle $\alpha$ to the longitudinal axis of the sound propagation at at least one of said inlet or outlet of said housing.

2. Apparatus in accordance with claim 1, wherein said positioning apparatus is functionally related to said separating wall and to said housing.

3. Apparatus in accordance with claim 2, wherein at least an area of said separating wall affected by said positioning apparatus is reinforced or is thicker.

4. Apparatus in accordance with claim 1, wherein said positioning apparatus is mounted between said separating wall and said housing, said first line, or said second line.

5. Apparatus in accordance with claim 1, wherein said positioning apparatus includes a tension spring, a foamed part, and/or a suspension.

6. Apparatus in accordance with claim 1, further comprising an external tube that comprises said housing and said second line.

7. Apparatus in accordance with claim 6, further comprising an internal tube that comprises said first line and said positioning apparatus.

8. Apparatus in accordance with claim 7, wherein said internal tube is inserted at least partially into said external tube such that said positioning apparatus is arranged mainly within said housing.

9. Apparatus in accordance with claim 8, wherein said internal tube has at least one aperture in the area of said positioning apparatus and in the area of said transmission wall.

10. Apparatus in accordance with claim 6, wherein said first line, said housing, said second line, and/or said external tube include(s) material comprising aluminum or plastic.

11. Apparatus in accordance with claim 1, wherein said separating wall and/or said transmission wall include(s) material comprising an elastomer film, a plastic film, or a textile membrane.

12. Apparatus in accordance with claim 1, wherein said transmission wall is gas-tight.

13. Apparatus in accordance with claim 1, wherein the angle $\alpha<\pm 10°$.

14. Apparatus in accordance with claim 1, wherein said transmission body is pot-shaped.

15. Apparatus in accordance with claim 7, wherein said transmission body has an edge joined to or integral with said transmission wall and acts on said housing.

16. Apparatus in accordance with claim 15, wherein said edge of said transmission body is mounted between a tube edge of said internal tube and an expansion of said external tube.

17. Apparatus in accordance with claim 1, wherein the acoustic transfer function is adjustable by adjusting the effective surface area of said transmission wall.

18. Apparatus in accordance with claim 17, wherein stiffness, a modulus of elasticity, at least one damping characteristic, and/or a mass of said transmission wall is/are variable as an adjustable property of the material.

19. Apparatus in accordance with claim 17, wherein said internal tube has a plurality of apertures and wherein the dimension of each aperture, the number of apertures, and/or the placement of said apertures is/are variable for adjusting the acoustic transfer function.

20. Apparatus in accordance with claim 1, wherein said housing comprises a tube, line, or hose, or is comprised of a tube, line, or hose.

21. Apparatus in accordance with claim 1, wherein said housing is arranged in a flow path of uncompressed intake air of the motor vehicle.

22. Apparatus in accordance with claim 1, wherein said housing is arranged in a flow path of compressed intake air of the motor vehicle.

23. Apparatus in accordance with claim 1, wherein the angle $\alpha<\pm 30°$.

24. Apparatus in accordance with claim 5, wherein the tension spring is a helical spring and/or the foamed part is a foam wedge.

25. Apparatus in accordance with claim 7, wherein said internal tube is stiff or rigid.

26. Apparatus in accordance with claim 8, wherein said internal tube comprises a plurality of apertures.

27. Apparatus in accordance with claim 6, wherein said internal tube includes material comprising aluminum, plastic, or foamed material.

28. Apparatus in accordance with claim 27, wherein the internal tube includes foamed material in the area of said positioning apparatus.

29. Apparatus in accordance with claim 13, wherein said transmission body is formed in the shape of a flower pot.

30. Apparatus in accordance with claim 15, wherein said transmission body is mounted between said housing and said first line.

31. Apparatus in accordance with claim 15, wherein said edge of said transmission body is mounted between a flange molded on said internal tube and a flange of said external tube that is detachably joined thereto.

32. Apparatus in accordance with claim 31, wherein the flange is detachably joined thereto.

33. Apparatus in accordance with claim 1, wherein the acoustic transfer function is adjustable by adjusting at least one property of the material of said transmission wall.

34. Apparatus in accordance with claim 9, wherein the acoustic transfer function is adjustable by adjusting at least one effective surface area of said aperture(s) in said internal tube.

35. Apparatus in accordance with claim 9, wherein the acoustic transfer function is adjustable by adjusting said aperture in said internal tube.

* * * * *

UNITED STATES PATENT AND TRADEMARK OFFICE

CERTIFICATE OF CORRECTION

PATENT NO. : 7,487,857 B2
APPLICATION NO. : 11/816408
DATED : February 10, 2009
INVENTOR(S) : A. Wolf It is certified that error appears in the above-identified patent and that said Letters Patent is hereby corrected as shown below:

| COLUMN | LINE | ERROR |
|---|---|---|
| (73) Pg. 1, col. 1 | Assignee | "**WOCO Industrietchnik GmbH,**" should read **--WOCO Industrietechnik GmbH,--** |
| (57) Pg. 1, col. 2 | Abstract 11 of text | "acoutis" should read --acoustic-- |

Signed and Sealed this

Twenty-third Day of June, 2009

JOHN DOLL
*Acting Director of the United States Patent and Trademark Office*